US008412381B2

(12) United States Patent
Nikovski et al.

(10) Patent No.: US 8,412,381 B2
(45) Date of Patent: Apr. 2, 2013

(54) HVAC CONTROL SYSTEM

(75) Inventors: Daniel Nikovski, Brookline, MA (US); Christopher Laughman, Waltham, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 404 days.

(21) Appl. No.: 12/730,326

(22) Filed: Mar. 24, 2010

(65) Prior Publication Data

US 2011/0238222 A1 Sep. 29, 2011

(51) Int. Cl.
*G05D 23/00* (2006.01)

(52) U.S. Cl. ..... 700/276; 700/291; 700/300

(58) Field of Classification Search ..... 700/9, 12, 700/275, 276, 291, 299, 300; 701/412, 414, 701/415, 423, 434
See application file for complete search history.

(56) References Cited

U.S. PATENT DOCUMENTS 5,555,927 A * 9/1996 Shah ..... 165/239
2002/0124000 A1* 9/2002 Ooishi ..... 707/10
2008/0280624 A1* 11/2008 Wrappe ..... 455/456.1

OTHER PUBLICATIONS

Gupta et al., "Adding GPS-Control to Traditional Thermostats: An Exploration of Potential Energy Savings and Design Challenges," Book Pervasive Computing, vol. 5538/2009, pp. 95-114 May 2009.
Wetter, "Multizone Building Model for Thermal Building Simulation in Modelica," United Technologies Research Center, Modelica 2006, Sep. 4-5, 2006; pp. 517-526.

* cited by examiner

*Primary Examiner* — Carlos Ortiz-Rodriguez
(74) *Attorney, Agent, or Firm* — Gene Vinokur; Dirk Brinkman

(57) ABSTRACT

A method controls a heating, ventilation, air conditioning (HVAC) system by determining a travel time from a mobile site to a fixed site, and determining a conditioning time for a HVAC system at the fixed site. The HVAC is maintained in an ON state if the travel time is less than the conditioning time, and otherwise maintaining the HVAC in an OFF state, and wherein the conditioning time is determined using a building thermal model.

19 Claims, 5 Drawing Sheets

Logic for Transmissions

| HVAC State | Site | Constraint |
|---|---|---|
| OFF | fixed | $\Theta > \lambda$ |
| OFF | mobile | $\lambda < \Theta$ |
| ON | fixed | $\Theta < \lambda - \varepsilon$ |
| ON | mobile | $\lambda > \Theta + \varepsilon$ |

301 302 303

*Figure 3*

HVAC CONTROL SYSTEM

FIELD OF THE INVENTION

The invention relates generally to the field of heating, ventilation, and air conditioning (HVAC) systems, and more particularly to energy saving programmable HVAC systems.

BACKGROUND OF THE INVENTION

Heating, ventilation, and air conditioning (HVAC) systems consume a large amount of energy. Commonly, heating and cooling operations for an environment are controlled automatically with one or more thermostats. A thermostat can be located centrally, or thermostats can be distributed. Typically, the operation of the HVAC system is according to preset temperature limits.

Because many environments may be unoccupied at times, this wastes energy. Occupancy can be determined with motion detectors. However, the time required to heat or cool the environment to the desirable temperature takes considerable time, perhaps longer than the time that the environment is occupied.

An operation schedule can be used. However, this is impractical when the occupancy period is irregular, or the schedule changes frequently. Schedules also do not accommodate holidays, vacations, travel, unplanned absence, and other changes to the occupancy routine. Thus, the schedule is only a best guess of occupancy.

One system augments manual and programmable home thermostats by using just-in-time heating and cooling based on travel-to-home distance obtained from location-aware mobile phones, Gupta et al., "Adding GPS-Control to Traditional Thermostats: An Exploration of Potential Energy Savings and Design Challenges," Book Pervasive Computing, Volume 5538/2009, pp. 95-114 May 2009. The system starts heating or cooling an inhabitable space only when the time necessary for the space's occupant to reach that space becomes lower than the time it would take to bring the space to a comfortable temperature.

That system used a GPS-enabled device such as a telephone to determine a user's current location, and a publicly available mapping system (MapQuest®) to compute the time to reach the space to be conditioned from the user's current location.

In order to compute the time necessary to bring the space to a comfortable temperature, that system uses empirical data stored in heating/cooling look-up tables. For a given combination of indoor and outdoor temperature, the table stores the time it would take to heat or cool the space to a comfortable temperature. Each table is specific to the heating/cooling system type installed at the particular location. That system lacks generalization, because the tables must be individually constructed for each residence from measurements. Furthermore, the observed data from a limited time period typically would not include all possible combinations of indoor and outdoor temperatures that might be encountered in the future.

Another disadvantage of that system is the need to constantly re-compute and compare the travel time and conditioning time. Since the GPS-enabled mobile device is typically powered by a battery, constant communication between the device and the conditioned space would quickly drain the mobile device's battery, and is also likely to result in costly data communications traffic.

SUMMARY OF THE INVENTION

A method controls a heating, ventilation, air conditioning (HVAC) system by determining a travel time from a mobile site to a fixed site, and determining a conditioning time for a HVAC system at the fixed site based on pre-computed building thermal models.

The HVAC is maintained in an ON state if the travel time is less than the conditioning time, and otherwise maintaining the HVAC in an OFF state, and wherein the conditioning time is determined using a building thermal model.

The mobile device carried by the spaces occupant and the building HVAC system installed at the conditioned space communicate according to a protocol that results in minimal data traffic.

BRIEF DESCRIPTION OF THE DRAWINGS

FIG. 3 is a table of conditional logic used by embodiments of the invention;

DETAILED DESCRIPTION OF THE PREFERRED EMBODIMENT

The embodiments of our invention provide a method for operating a heating, ventilation, and air conditioning (HVAC) system. The method uses a travel time for a person to reach the environment being controlled, and the conditioning time of the HVAC system.

Figure 1:
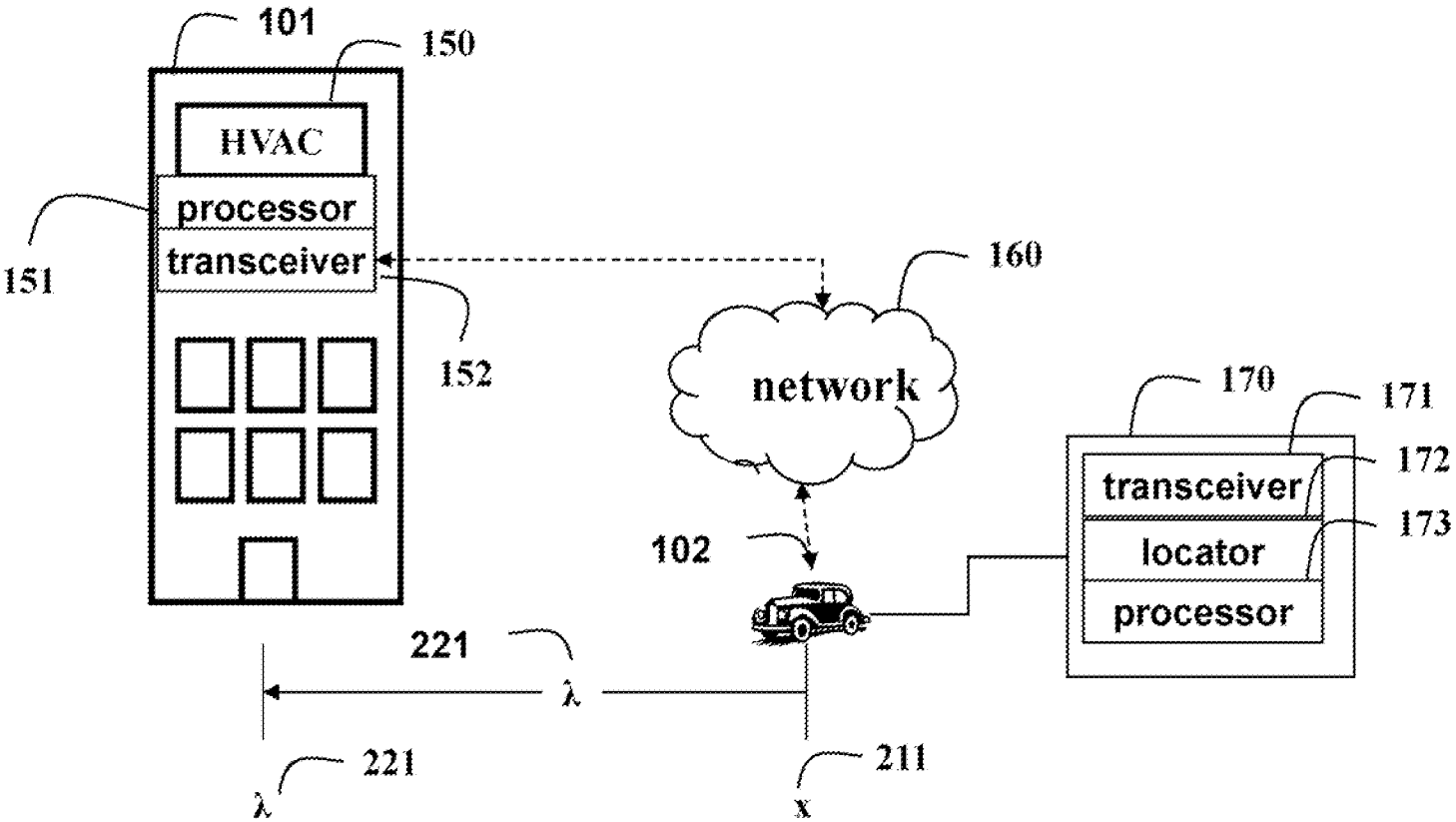
FIG. 1 is a schematic of a system for controlling a HVAC system according to embodiments of the invention.

FIG. 1 shows a fixed site (a workplace) 101, and a mobile site 102 at a location x 211, e.g., the mobile site is traveling to the fixed site. The mobile site includes a person destined for the fixed site. The mobile site can be a car, public transportation, a bicycle, or a person carrying a mobile communications device 170. The device 170 includes a mobile transceiver 171, a mobile locator 172, and a mobile processor 173.

The fixed site 101 includes a HVAC system 150, which is connected to a fixed transceiver and a fixed processor 151 and a fixed transceiver 152 similar to the mobile transceiver 171. In a simplest form, the HVAC system includes a boiler, and perhaps air circulation means.

The fixed site and the mobile site can communicate with each other via a network 160, e.g., the Internet, using the transceivers 152 and 171.

The travel time $\lambda$221 for the mobile site to arrive at the fixed site 101 can be estimated from the locations x 211 of the mobile site 102. The locations can be sensed using the locator 172, e.g. a global positioning system (GPS), or a mobile communication device, e.g., mobile telephone in the vehicle, and the location of the mobile site is provided by a mobile telephone service provider. The locator can also be a BlueTooth® device communicating with a fixed-location BlueTooth beacon. The travel time can also consider traffic and weather conditions between the mobile and fixed sites, as available via the network.

The fixed site estimates 230 the conditioning time $\Theta$ 231 from environmental conditions 229 and a building thermal model 228. The environmental conditions can include the external temperature and direct sunlight illumination at the fixed site. It is assumed these are constant or slowly varying, and if not, they can be adjusted for diurnal and annual variations, and according weather forecasts, also readily available via the network.

The building thermal model 228 represents the thermal response of the building to the environmental conditions (e.g., external temperature, sunlight) and the operation of the HVAC system 150 that actively moves heat in or out of the building. A popular type of building thermal model is a grey-box model, where the building is modeled as a thermal circuit. The building thermal model can include factors such as thermal gain and transmission through windows, convection and conduction, shading and insulation. The building thermal model tracks the state of the building continuously and for any amount of heat supplied by the HVAC system 150, and can predict the future evolution of the internal temperature of the building. In order to compute the conditioning time Θ231, the building thermal model is used to determine the future evolution of the internal temperature for the case when the HVAC system 150 is operated at full power. The time necessary for the internal temperature to reach a comfortable threshold, e.g. 70 F, is determined to be the conditioning time Θ231.

A difference 241 between the travel time 221 and the conditioning time 231 is computed 240. The difference is then used to determine how the operation 250 of the HVAC system 150 is maintained.

Figure 2A:
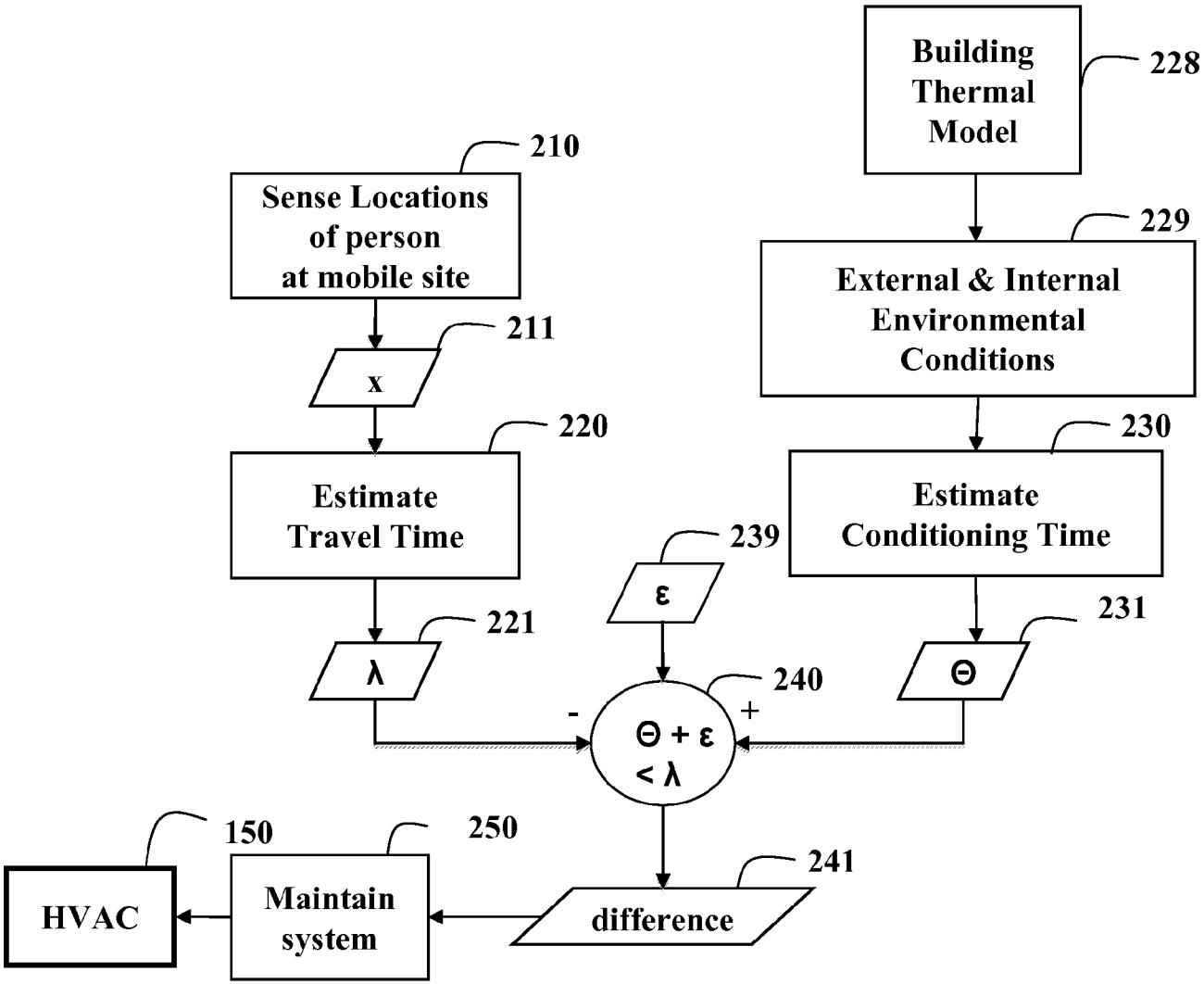
FIG. 2A is a flow diagram for controlling a HVAC system according to embodiments of the invention.
Figure 2B:
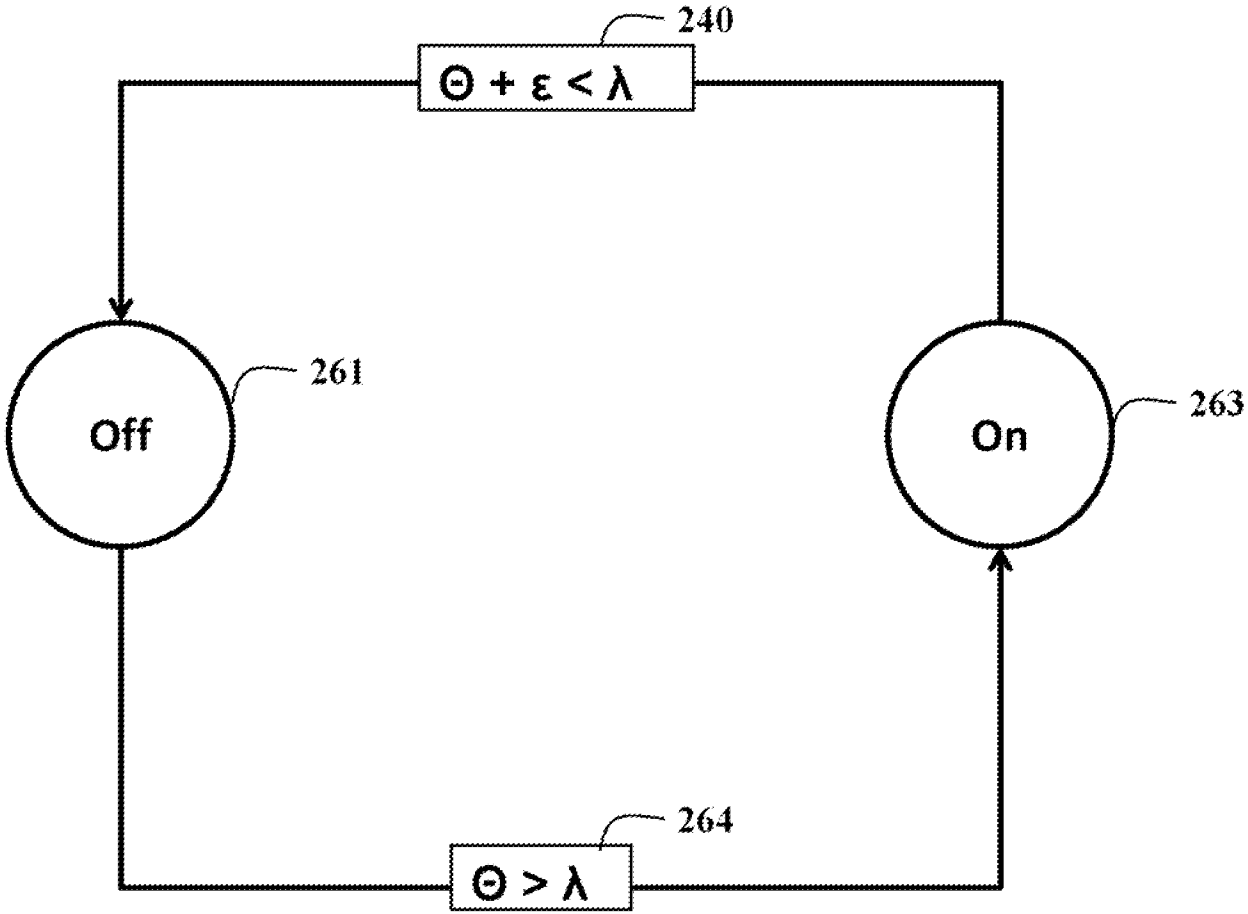
FIG. 2B is a state transition diagram for controlling the HVAC system according to embodiments of the invention.

As shown in FIG. 2B, the HVAC is maintained in an OFF state 261 until the conditioning time constraint 264 is satisfied. Then, the HVAC is maintained in an ON state 263 until the conditioning time constraint 240 is satisfied. The travel time can also be based on schedules of public transportation. The travel time can be determined at either the fixed or mobile location. The travel time can be periodically transmitted, or either the fixed or the mobile site can initiate the communication of the travel time explicitly.

FIG. 3 shows the logic used by an embodiment of our invention to schedule communication between the fixed and mobile sites. In this embodiment, there is no regularly scheduled communication, either the fixed or mobile site can initiate a communication. FIG. 3 shows the currently maintained states 301 of the HVAC system, the sites 302, and the constraints 303 based on the travel time λ, the conditioning time Θ, and the threshold time ϵ.

Whenever there is a communication between the sites, the mobile site communicates the travel time λ221 to the fixed site, and the fixed site communicates the conditioning time Θ231, and the currently maintained state 301 of the HVAC system to the mobile site. The fixed site stores λ and the mobile site stores Θ. For each current state 301 of the HVAC, a communication is initiated by the site 302, when the constraint 303 becomes true for the corresponding state of the HVAC system.

Figure 4B:
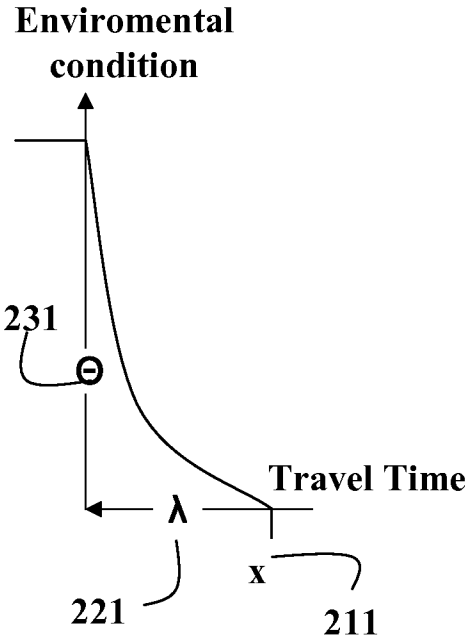
FIGS. 4A-4B are graphs of environmental conditions as a function of travel time.
Figure 4A:
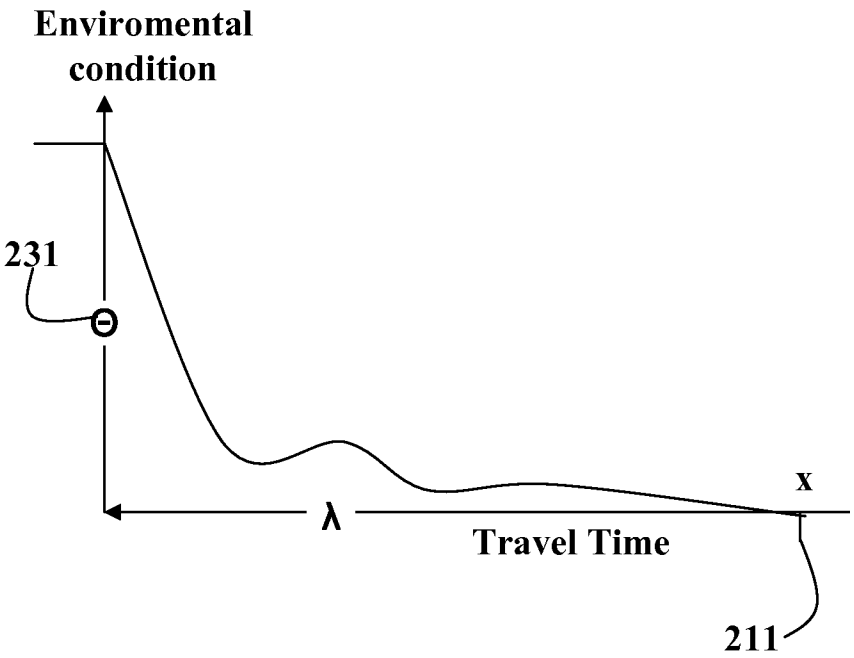

As shown respectively in FIGS. 4A and 4B, it should be noted that when the HVAC system is ON, the system can operate in various modes. For example, if the travel is relatively large, then the HVAC can condition the environment slowly over a long period. That is the output of the HVAC system 'ramps-up' slowly. This minimizes energy consumption. If the travel time changes, the conditioning time can change accordingly. If the travel time is short, the HVAC might need to operate at maximum capacity to reach the desired internal environment condition. That, is the conditioning time is approximately proportional to the travel time. Thus, in one embodiment, the travel time from the mobile site to the fixed site is determined, and an operation of the HVAC system is set according to the travel time.

In another embodiment, multiple instances of the method can collaborate to minimize communications by the mobile site. For example, the person associated with the mobile site can be at the fixed workplace site and a fixed residence. In this case, the travel time and condition time can be determined for each sites, depending on whether the person is going to work, or coming home.

The HVAC system can be for an environment that can be occupied by multiple individuals. In this case, the travel time, conditioning, and conditional logic is determined for each individual, and the HVAC is maintained in the ON state when any one condition indicates that this should be the case, and in the OFF state when all conditions indicate that this should be the case.

In the case wherein N individuals share the same environment, but have different preferences for the environmental condition, the fixed site can calculate a separate Θ for each occupant ($\Theta_1$, $\Theta_2$, $\Theta_3$ . . . $\Theta_N$), and each mobile site can communicate a separate λ, i.e., ($\lambda_1, \lambda_2, \lambda_3, \ldots, \lambda_N$). Furthermore, the HVAC system can use a separate threshold time ϵ for each occupant ($\epsilon_1, \epsilon_2, \epsilon_3 \ldots \epsilon_N$). The HVAC transitions to the ON state when any of the conditioning times ($\Theta_1$, $\Theta_2$, $\Theta_3 \ldots \Theta_N$) is greater than its corresponding travel time ($\lambda_1, \lambda_2, \lambda_3, \ldots, \lambda_N$). The HVAC transitions to the OFF state when $\Theta_N$ plus a threshold time $\epsilon_N$ is less than the travel time $\lambda_N$ for all corresponding Ns.

It should be noted that the method can also be used for other equipment, e.g., lighting, in which case Θ=0, boilers, coffee makers, and water coolers. For desktop computers, the conditioning time is the time required to activate the computer, and Θ is a constant.

Thus, in the general case, the system is any equipment in or for an environment that needs to be maintained in an ON state when individuals are in the environment, and in an OFF state when the environment is unoccupied. The system is most effective at saving energy when the conditioning time is significantly greater than zero, so that the system can assure the comfort of occupants by starting to condition the space significantly before the occupants arrive, but at the same time is less than the travel time of the occupants for long periods, so that it can safely conserve energy during such periods.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. A method for controlling a heating, ventilation, air conditioning (HVAC) system, comprising the steps:

determining a travel time from each of a plurality of mobile sites to a fixed site;

determining a conditioning time for a HVAC system at the fixed site;

turning the HVAC system ON when any of the travel times is less than the conditioning time;

turning the HVAC system OFF when all of the travel times are greater than the conditioning time plus a threshold time, wherein the conditioning time is determined using a building thermal model, and wherein the steps are performed in a processor;

wherein each mobile site communicates a separate travel time to the fixed site;

wherein the fixed site calculates a separate conditioning time, and the HVAC system uses separate threshold times for occupants sharing a same environment; and wherein each mobile site includes a mobile transceiver and a mobile locator, and wherein the fixed site includes the processor and a fixed transceiver for communicating with each mobile site via a network.

2. The method of claim 1, wherein the mobile locator is a global positioning system.

3. The method of claim 1, wherein the mobile locator is a mobile telephone, and a location of the mobile site is provided by a mobile telephone service provider.

4. The method of claim 1, wherein the travel time is determined from locations of the mobile site,

5. The method of claim 1, wherein the travel time depends on traffic and weather conditions.

6. The method of claim 1, wherein. the travel. time is based on probabilistic. information obtained from previous traveling patterns, and considers a mode of travel, time of day, date, and day of week.

7. The method of claim 1, wherein the travel time is determined based on schedules of public transportation.

8. The method of claim 1, wherein the travel time is determined at either the fixed site or the mobile site.

9. The method of claim 1, wherein the travel time is transmitted to the fixed site periodically.

10. The method of claim 1, wherein the travel time is transmitted at a request by either the fixed site or the mobile site.

11. The method of claim 1, wherein the conditioning time is constant.

12. The method of claim 1, wherein the conditioning time is adjusted for diurnal and annual variations, and according weather forecasts.

13. The method of claim 1, wherein the conditioning time is adjusted for internal environmental conditions at the fixed site.

14. The method of claim 1, wherein the conditioning time maximizes performance of the HVAC system.

15. The method of claim 1, where the conditioning time is approximately proportional to the travel time.

16. The method of claim 1, in which the fixed site estimates a separate conditioning time for each mobile site.

17. The method of claim 1, wherein the conditioning time is slowly varying.

18. The method of claim 1, wherein the model considers thermal gain and transmission through windows, convection and conduction, shading and insulation.

19. The method of claim 18, wherein the conditioning time satisfies a thermal property constraint.

* * * * *